US006585178B1

(12) United States Patent
Kraemer et al.

(10) Patent No.: US 6,585,178 B1
(45) Date of Patent: Jul. 1, 2003

(54) VERTICAL ROTOR MILL

(75) Inventors: Guido Kraemer, Zuckenriet (CH); Laszlo Jud, Berg (CH)

(73) Assignee: Bühler AG, Uzwil (CH)

( * ) Notice: Subject to any disclaimer, the term of this patent is extended or adjusted under 35 U.S.C. 154(b) by 0 days.

(21) Appl. No.: 09/806,190

(22) PCT Filed: Sep. 24, 1998

(86) PCT No.: PCT/CH98/00408

§ 371 (c)(1),
(2), (4) Date: May 18, 2001

(87) PCT Pub. No.: WO00/18509

PCT Pub. Date: Apr. 6, 2000

(51) Int. Cl.[7] ..... B02C 13/284
(52) U.S. Cl. ..... 241/74; 241/285.2
(58) Field of Search ..... 241/74, 285.2, 241/285.3, 73

(56) References Cited

U.S. PATENT DOCUMENTS 3,169,711 A 2/1965 Helms
4,243,180 A 1/1981 Bonnel
5,232,168 A 8/1993 Lybecker et al.

FOREIGN PATENT DOCUMENTS

| | | |
|---|---|---|
| CH | 686875 | 7/1996 |
| DE | 3636869 | 5/1987 |
| DE | 8810234 | 11/1988 |
| EP | 0525362 | 2/1993 |
| EP | 0556645 | 8/1993 |

*Primary Examiner*—Mark Rosenbaum
(74) *Attorney, Agent, or Firm*—Horst M. Kasper

(57) ABSTRACT

The invention relates to a vertical rotor mill, especially to an impact pulverizer or to a hammer mill for grinding granular material using impact tools (8). Said tools are fixed to a rotating, vertically arranged rotor (7) which is enclosed by a screen (9). The grinding chamber (19) is in turn enclosed by a conic housing (6). The aim of the invention is to simplify access to the screen (9) and to the impact tools (8), and to improve the operating characteristics. To this end, the cone (6) can be lowered together with the screen (9).

13 Claims, 4 Drawing Sheets

VERTICAL ROTOR MILL

Figure 1:
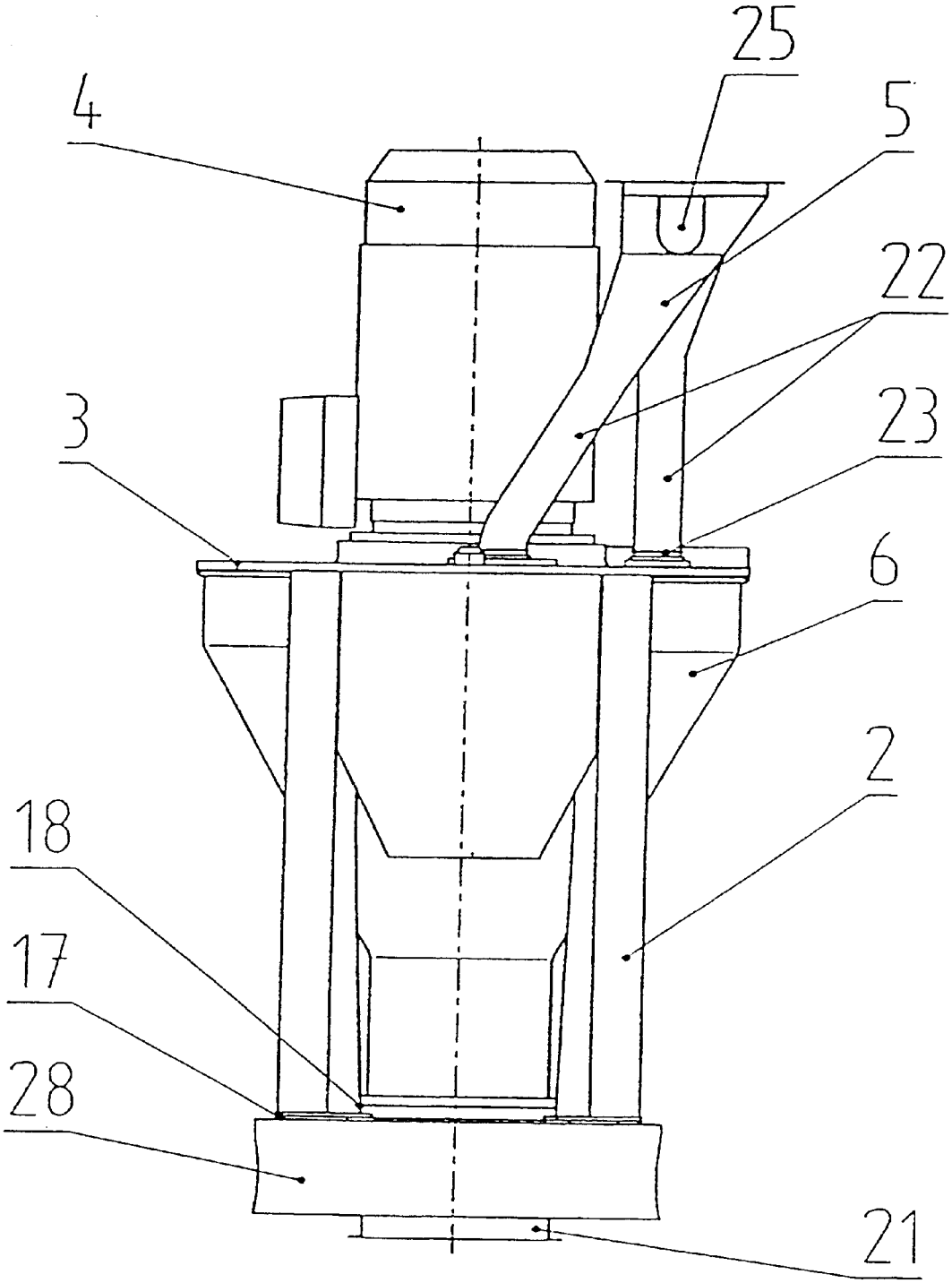

The invention relates to a vertical rotor mill, in particular a hammer mill or an impact grinding mill for milling granular materials by means of beater tools mounted on a rotating, vertically arranged rotor.

Various embodiments of hammer mills or impact grinding mills having the axes of rotation of the rotors arranged either vertically or horizontally are known. For example, German Utility Model DE-U 8,810,234 describes a hammer mill having a vertical drive shaft with the drive beneath it. Unexamined German Patent DE-OS 3,636,869 describes a beater arm mill having a beater arm rotor arranged so it can rotate about its vertical axis. The material to be milled is supplied by a feed mechanism arranged on the top side of the mill.

European Patent Application EP-A 556,645 discloses an impact grinding mill having a housing in which is arranged a vertical rotor equipped with beater tools, where at least one inlet opening for the material to be milled is provided above the beater tools on the top side of the housing. The beater tools are arranged in groups in the direction of the axis of rotation, with those of one group lying in the same axis perpendicular to the axis of rotation. At least the ends of the beater tools of the top group on the outer end radially are located less far toward the outside than those of at least one lower group.

The impact grinding mill is operated on ambient air. The housing of the impact grinding mill is made of a lower conical collecting part and an upper cylindrical mill housing part. The mill housing part in turn surrounds a milling space, a screen and a discharge area for fine particles.

Vibration-absorbing gaskets are provided between the two housing parts. To improve the vibration-absorbing effect, Swiss Patent CH-A 686,875 proposes that the top side of the mill housing part be designed in the form of a top part such that at least three vibration absorbing devices containing spring elements arranged in a uniform distribution around the outer periphery of the mill housing, and in addition, a flange on the mill housing part is flexibly connected to the top part. The height of the connection between the mill housing part and the top part is adjustable (air gap). The resulting air gap is sealed by a gasket.

Impact grinding mills with cup-shaped screens are also known, e.g., according to U.S. Pat. Nos. 3,169,711 and 4,243,180, where the end face of the screen is oriented vertically or horizontally. In both cases, it is complicated to mount and remove the screens, because a multitude of parts must be removed. With large hammer mills, the screen is heavy and has a large jacket wall height, so that it is difficult to being it above the rotor without tilting it. European Patent EP-B 525,362 proposes a device whereby mounting and dismantling of the screen should take place rapidly and safely. To do so, at least two holders which are distributed around the periphery of the screen can be displaced between two stops by means of a linear guidance of the screen. One stop is selected so that the cup-shaped screen can be removed from the screen by moving it past the mill, and the other stop is reached when the rotor is surrounded by the screen jacket and the outer edge of the screen jacket projects on a corresponding sealing surface. Access to the screen or changing the screen must be accomplished through a door in the mill housing, which is not only tedious and time-consuming but can also interfere with sanitation and safety from hazards.

Therefore, the object of this invention is to simplify access to the screen and to the screen and to the beater tools of a vertical rotor mill and to improve the operating properties and expand the range of use of such mills.

The bottom part of the housing of the vertical rotor mill is designed in the form of a cone that surrounds the screen and can be lowered. In the lowered condition, the screen can be displaced by analogy with European Patent EP-B 525,362. The screen basket itself is designed in one or more parts, and the screen plate is preferably designed with all screen holes the same. The screens themselves are perforated with a special pitch and direction (overlapping in the longitudinal direction), which improves milling.

To improve the vibration-absorbing effect and the sound-absorbing effect, the motor flange is arranged in or on absorber elements or an absorber cuff.

Assembly and disassembly of the screen and also an eventual cleaning are significantly simplified by measures which are seemingly simple when taken separately. At the same time, the operating reliability is increased by a new safety concept, namely, access to the rotor and beater tools is impossible in the operating state.

Figure 2:
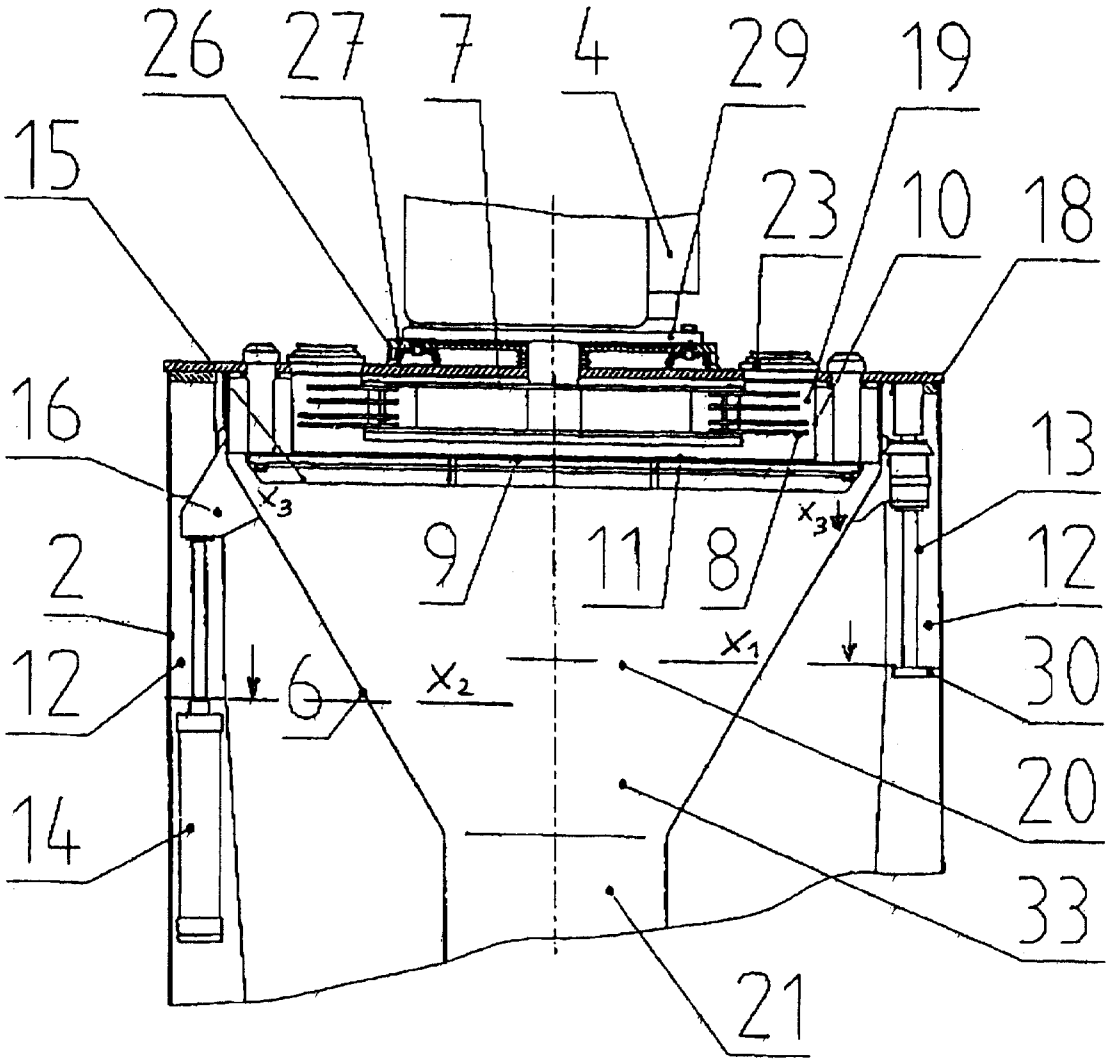
Figure 3:
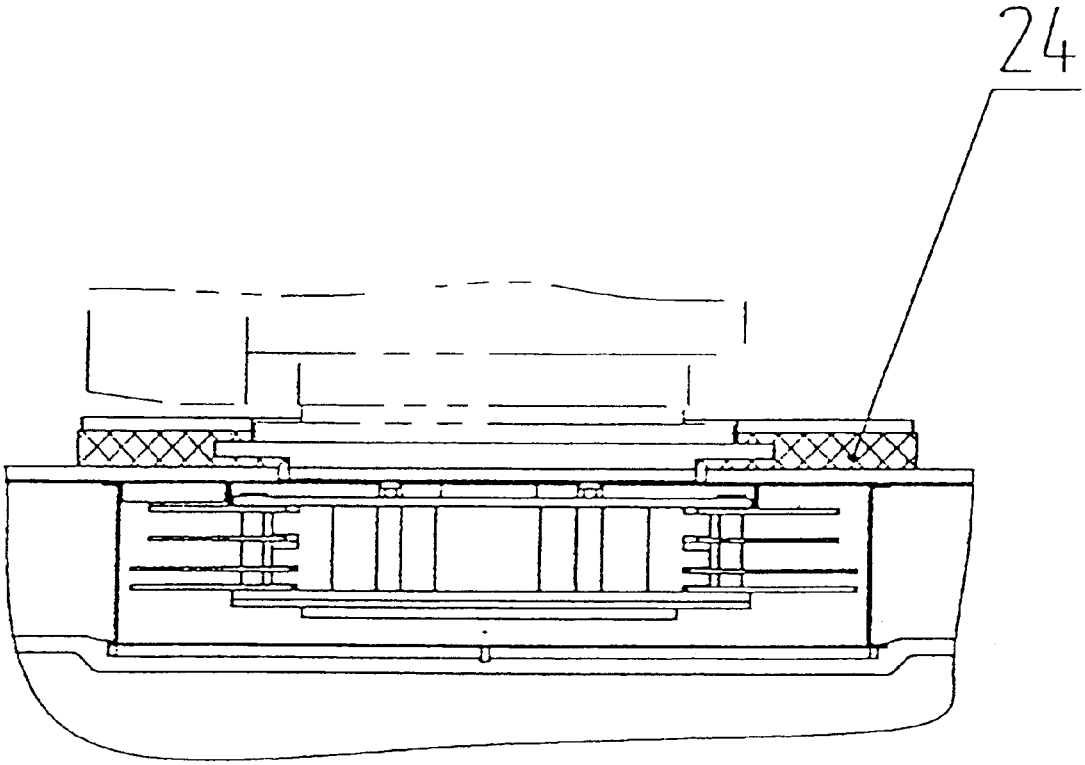
Figure 4:
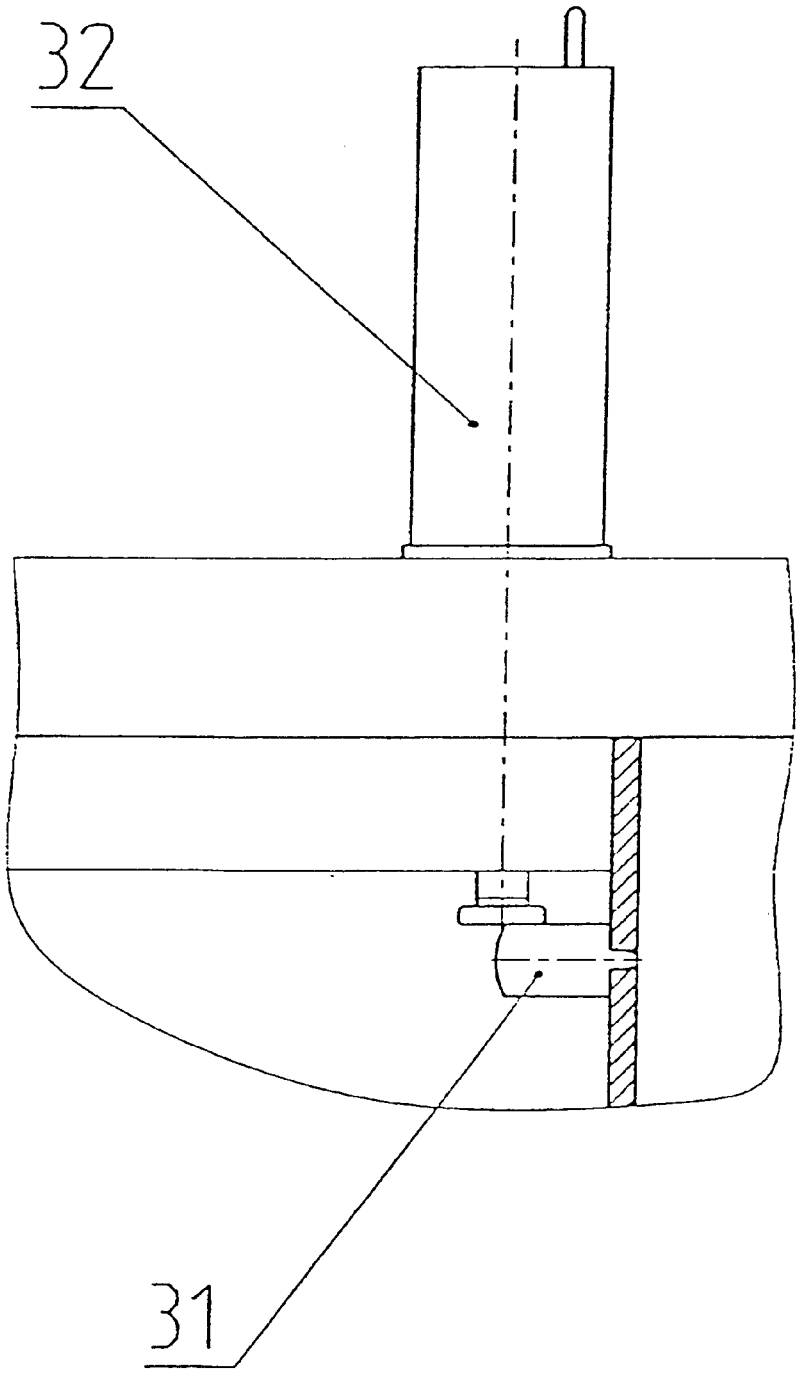

This invention is described in greater detail below on the basis of one embodiment as illustrated in drawings, which show:

FIG. 1: a side view of the vertical rotor mill;

FIG. 2: a partial sectional view of the cone;

FIG. 3: a partial sectional view according to FIG. 2 in another variant;

FIG. 4: a detail of the screen jacket.

A vertical rotor mill 1 consists essentially of a load-bearing frame 2 which is connected to a base plate 3 having a motor 4 on its top side to serve as a drive for a rotor 7 which rotates about an essentially vertical axis of rotation, as well as a cone 6 in which the rotor 7 is arranged. The motor 4 sits in an absorber cuff 24 on absorber elements 26. In addition, a material feed mechanism 5 is arranged on the base plate 3.

Beater tools 8 arranged on rotor 7 on the outside radially are mounted so they can pivot about pivot axes essentially parallel to the axis of rotation. Beater tools 8 are preferably arranged in groups in the direction of the axis of rotation, with the radially outer ends of the beater tools 8 of the individual groups arranged at different radial distances intermittently and with beater tools 8 also arranged eccentrically in a group. Beater tools 8 of one group are thus provided with different radii, based on the outer ends radially.

A sensor 29 is provided on the drive train to detect an imbalance. In comparison with the state of the art, a greater number of beater tools 8 are used in the normal case here (4 to 12 stations are possible).

In the operating state, rotor 7 and beater tools 8 are surrounded at the side and at the bottom by a screen 9. This is preferably a cylindrical cup-shaped screen consisting of a perforated screen jacket 10 in one or more parts and a perforated screen plate 11. The perforations in screen plate 11 itself are preferably the same for different applications, which greatly simplifies the warehousing of replacement parts as well as simplifying the milling itself. A special perforation permits an open screen area of at least approx. 50%. The screen jacket 10 as a screen basket preferably consists of only one part. A multi-part design is also possible, in particular to reduce the shipping volume.

It is possible to provide screen recognition, whereby the screen jacket 10 has bolts 31 arranged at a specific spacing (depending on the size of the holes) A presence and/or distance measurement is performed by means of another sensor, namely a potentiometer 32 here, so that a screen can be identified and allocated, also with respect to the grinding stock.

For cleaning or replacing the screen 9, it is mounted so it can be pivoted together with the cone 6 until rotor 7 and screen 9 are completely exposed.

Straight-line guides 13 provided in the hollow columns 12 of the frame 2 are connected to at least one lifting device, preferably a pneumatic cylinder 14. The connection between cone 6 and straight-line guide 13 is provided by way of connecting point 16 and the connection between cone 6 and screen 9 is established through connecting point 15. The vertical path of cone 6 is limited at the upper end by screen jacket 10 and at the lower end by cylinder 14. The vertical path of screen 9 is limited at the lower end by a vertical guide with a stop 30.

On the one hand, there is therefore unhindered access to the screen 9 and the beater tools 8 as well as the interior of the cone 6, while on the other hand, access to screen 9 and rotor 7 is impossible during operation.

The interior of the cone 6 is divided by screen 9 into two subspaces, a milling space 19 where the rotor 7 is arranged and a collecting space 20 where the milled material is collected. The milled material can be discharged through at least one outlet opening 21 which is provided at the lower end of the collecting space 20.

The cone 6 and the base plate 3 as well as the milling space 19 are designed to resist pressure surges in this embodiment.

The material to be milled is supplied through a feeder mechanism, material feed mechanism 5. The material goes through connection 22 and at least one inlet opening 23 into milling space 19. Conventional heavy stock separation devices or magnetic separators such as those described in European Patent EP-B 556,645 or Swiss Patent CH-A 686, 875 may be connected upstream from the material feed mechanism 5.

A material can be supplied to the inlet openings 23 of the mill in a metered and continuous manner by means of this feed mechanism.

A pressure equalizing port 25 is provided to prevent an excess pressure or a reduced pressure in the milling chamber (collecting space 19). The pressure conditions are regulated by pressure sensor 33. The operating status of the mill 1 with regard to vibration, bearing damage, beater break or foreign parts, for example, can be monitored by means of sensors 29, 33.

The connections 22 have a round cross section and can be replaced easily in the event of wear.

A feeder mechanism can supply material through just one or two vertical rotor mills 1 in parallel, as already described in European Patent EP-B 556,645.

For vibration and noise damping, the flange 27 of the motor 4 is flexibly mounted on absorber elements 26 or in a flange-shaped absorber cuff 24.

The frame 2 is preferably arranged on an intermediate bottom 28 of a mill building by means of bottom plate 17. Bottom plate 17 has an opening which is mounted concentrically with outlet opening 21. The opening of the bottom plate 17 has an inflatable telescopic gasket 18 which surrounds the outlet opening 21 and seals the opening in the inflated state. The telescopic gasket 18 is vented before a vertical movement of the cone 6.

Reference Notation

1 vertical rotor mill
2 frame
3 base plate
4 motor
5 material feed mechanism
6 cone
7 rotor
8 beater tool
9 screen
10 screen jacket
11 screen plate
12 column
13 straight-line guide
14 pneumatic cylinder
15 connecting part
16 connecting part
17 bottom plate
18 telescopic gasket
19 collecting space
20 collecting space
21 outlet opening
22 connection
23 inlet opening
24 absorber cuff
25 pressure equalizing opening
26 absorber element
27 flange
28 intermediate bottom
29 sensor
30 stop
31 bolt
32 potentiometer
33 pressure sensor

What is claimed is:

1. Vertical rotor mill for grinding stock, wherein a casing in the form of a cone (6) is situated adjacent to a milling room (19), and accommodates a vertically standing rotor (7) equipped with grouped striking tools (8) and a motor (4), with at least one inlet hole (23) for the stock being provided above the striking tools (8) on the top side of the casing, a beaker-shaped screen (9) enveloping the striking tools (8), which can be vertically shifted, and, an outlet hole (21) provided on the bottom side of the cone (6), characterized by the fact that the screen (9) is moveably coupleable with the cone (6) and can be vertically moved together with it.

2. Vertical rotor mill according to claim 1, characterized by the fact that the radially outlying ends of the striking tools (8) of the individual groups lie radially alternatingly far to the outside, and the striking tools (8) are situated eccentrically in a group.

3. Vertical rotor mill according to claim 1, characterized by the fact that a flange (27) of the motor (4) is flexibly mounted on dampening elements (26) or in a dampening cuff (24).

4. Vertical rotor mill according to claim 1, characterized by the fact that a screen jacket (10) of the screen (9) has varying hole patterns, and the open screen surface measures approximately 50%.

5. Vertical rotor mill according to claim 1, characterized by the fact that a screen floor (11) is provided with only one hole size.

6. Vertical rotor mill according to claim 1, characterized by the fact that it can be operated as a single or dual machine, wherein the stock is supplied via a shared stock feeder (5) in dual operation.

7. Vertical rotor mill according to claim 1, characterized by the fact that a floor plate (17) is provided as part or independently of a rack (2) of the vertical rotor mill (1), which has a hole with an inflatable telescopic seal (18), which envelops the outlet hole (21) and seals it when inflated.

8. Vertical rotor mill according to claim 1, characterized by the fact that a sensor (29) is situated in a drive train.

9. Vertical rotor mill according to claim 1, characterized by the fact that the screen jacket (10) has at least one coding element in a bolt (31), which is fixed at a specific distance to the base plate (3) as a function of, the hole size of the screen (9).

10. Vertical rotor mill according to claim 1 of the characterized by the fact that the screen (9) is provided with a hole pattern that overlaps in the running direction.

11. Vertical rotor mill according to claim 1 of the characterized by the fact that a sensor (29) is allocated to the motor (4) and a sensor (33) is allocated to the cone (6) to monitor the operating condition of the vertical rotor mill.

12. Vertical rotor mill according to claim 1, characterized by the fact that the traveling path of the screen (9) is limited below by a stop (30).

13. Vertical rotor mill according to claim 12, characterized by the fact that the stop (30) is situated above a cylinder (14) in a vertical direction, so that the cone (6) can be lowered further than the screen (9).

* * * * *